US005542123A

United States Patent [19]

DiPietro

[11] Patent Number: 5,542,123

[45] Date of Patent: Aug. 6, 1996

[54] CHILDREN'S GARMENT WITH CARRYING MEMBER

[76] Inventor: Don DiPietro, 5656 Tuxedo Ter., Los Angeles, Calif. 90068

[21] Appl. No.: 250,269

[22] Filed: May 27, 1994

[51] Int. Cl.[6] ..... A41D 1/00

[52] U.S. Cl. ..... 2/80; 2/69.5; 2/94

[58] Field of Search ..... 2/69, 69.5, 75, 2/80, 94, 271, 1, 93, 111, 247, 311; 119/725, 857; 190/115, 116; 150/110

[56] References Cited

U.S. PATENT DOCUMENTS

| | | | |
|---|---|---|---|
| 1,473,789 | 11/1923 | Killfeather . | |
| 2,568,304 | 9/1951 | Schoenbrun | 2/93 X |
| 3,074,074 | 1/1963 | Lovering | 2/94 |
| 3,997,921 | 12/1976 | Knight . | |
| 4,449,253 | 5/1984 | Hettinger | 2/94 X |
| 5,369,804 | 12/1994 | Metcalf | 2/69 |

*Primary Examiner*—C. D. Crowder
*Assistant Examiner*—Shirra L. Jenkins
*Attorney, Agent, or Firm*—Kenyon & Kenyon

[57] ABSTRACT

For lifting, supporting, or carrying a child, a garment composed of material with sufficient strength to support the child's weight independently, or by incorporating reinforced seams, or by an integrated harness. The garment includes a handle that is securely fastened thereto to enable an adult to raise the child from the floor and carry the child with minimum discomfort and safety. The handle is typically attached to a portion of the garment which is reinforced in some fashion so that the stress on the child is distributed throughout the garment to minimize focusing a force on any one area of the anatomy. The handle can be readily gripped by an adult and will typically be found on the back of the garment. The handle portion may be aligned either horizontally or vertically. The garment, in connection with the handle, is configured so as not to injure the child while permitting maximum support for carrying the child by gripping the handle.

16 Claims, 6 Drawing Sheets

CHILDREN'S GARMENT WITH CARRYING MEMBER

BACKGROUND OF THE INVENTION

Young children, particularly toddlers, must be carried in a manner which is safe and comfortable for both child and the parent. Safely lifting a child from the floor requires the parent to bend down and usually use both hands. This is an awkward and back stressing procedure which in a confined space is difficult for both the parent and the child.

Particularly when travelling, where the parent and child are in relatively confined quarters such as on an airplane or train, often one must struggle to lift the child from the aisle where the child had been sitting. In an effort to overcome this problem, a handle and garment system has been developed which permits the adult to more readily lift and move the child in close and confined quarters.

Although handles and tabs on garments have existed before, they have not been of a form or oriented in connection with other portions of the garment to permit the child to be lifted entirely through use of the handle. In the invention, as described in more detail below, the handle is secured to the rear portion of a child's garment. A series of integrated harness elements or seams distribute the stress imparted by the handle over the torso of the child to minimize the focus of stress on any one area. The garment is configured such that when the handle is used, the child can be moved without injury and with minimal discomfort. The handle, garment, and integrated harness are made out of a material that can withstand the forces imparted during this kind of movement while maintaining comfort to both the child as well as the adult when in use.

SUMMARY OF THE INVENTION

The invention provides a garment for a child, and more particularly a garment with a torso portion, two sleeve portions, two leg portions, and a handle secured to said torso portion for permitting carrying of the child via the handle without injury to the child. The handle may include a gripping portion arranged and displaced from the rear of the garment by two handle extensions, one from each end of the gripping portion. The handle extensions are fixed to pads, each extension respectively fixing a handle to the garment. Generally, the handle is affixed to said garment beneath the neck portion and between the sleeves of the garment.

The garment includes a pattern of seams for reinforcing the garment to support a child. The garment may also have two shoulder portions, a neck portion between the two shoulder portions, and a crotch. The reinforcing portion includes reinforced seams extending between the shoulder portion and the crotch along the rear portion of the garment and the shoulder and the crotch along the front portion of the garment.

The reinforced portion may also include reinforced seams extending between the crotch and the underarms of the sleeves and extending around to the front portion at the midriff of the garment. Furthermore provided is a reinforced transverse seam extending between the two pads of the handle and connecting the shoulder seams. Moreover, upper underarm seams may be provided that extend between the underarms of the garment and intersect with the shoulder seams at the intersection of the transverse seam. In all of these, a separable fastener, such as a zipper, a buckle, or a series of buttons, may be provided for attaching the front portion of the garment.

In another embodiment, the handle is arranged in a vertical position. In a further embodiment, the handle is an inverted pocket on the back of the garment.

The handle may be provided with a cosmetic overflap for covering said handle.

In another embodiment, the garment includes at least one strap and at least one eyelet connected to the garment in such a way that the strap is capable of being connected to the eyelet so as to support a child via the strap.

In still another embodiment the garment includes at least one adjustable strap and at least two adjustable buckles such that the handle is connected between two of the buckles and such that the adjustable buckles are capable of being moved so as to attach to different places on the adjustable strap.

In a further embodiment, a handle for a garment for a child is provided with a handle section and a stitching section connected to the handle section such that the stitching section may be stitched to an existing article of clothing.

DETAILED DESCRIPTION OF THE PREFERRED EMBODIMENTS

Figure 1B:
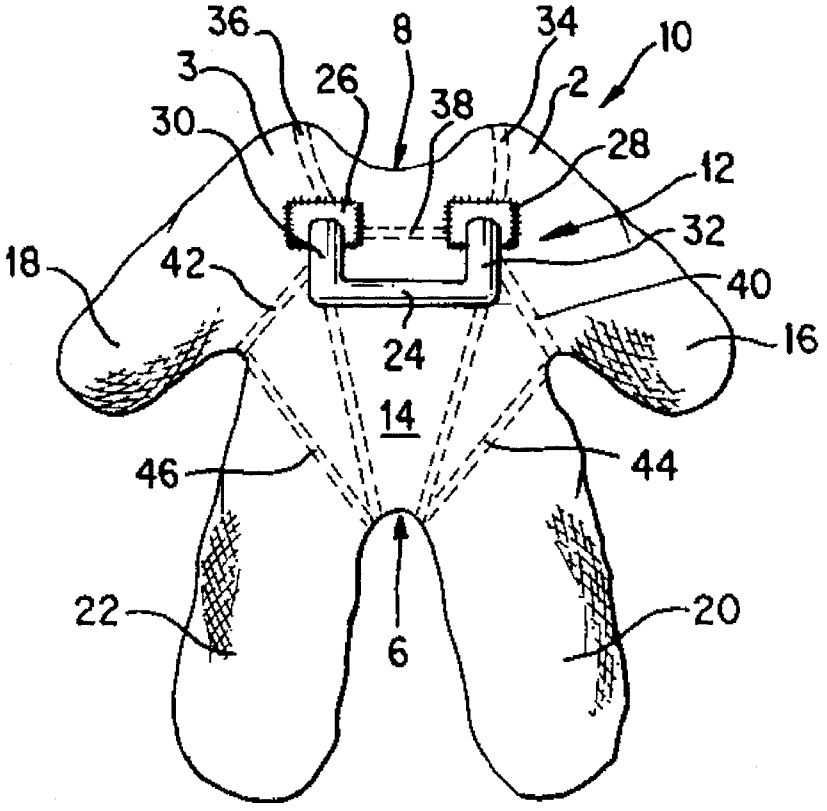
FIG. 1 shows front and back views of a garment of the present invention with a transverse handle.
Figure 1A:
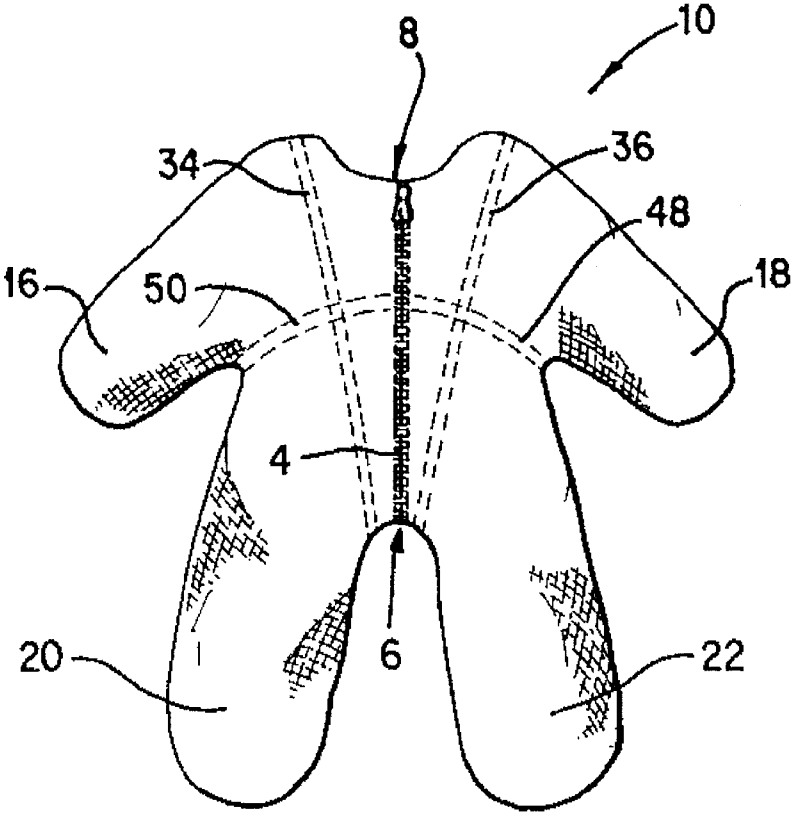

As shown in FIG. 1, the garment includes a torso portion 14 having sleeves 16 and 18 for the arms, respectively, and leggings 20, 22 in the usual configuration. A neck portion 8 is configured in the usual fashion for permitting the child's head to extend therethrough between shoulder portions 2, 3 where the sleeves terminate. A handle 12 is secured to the rear portion of the garment and beneath the neck portion 8 and between the sleeves 16, 18 as shown.

In this embodiment, reinforced seams are made part of the garment to which the handle is ultimately secured. The handle 12 includes a gripping portion 24 that extends laterally and attaching pads 26 and 28 for attaching extension portions 30 and 32 which extend from each end of gripping portion 24 to the garment as shown. Various reinforced seams are utilized to strengthen the garment for supporting the child when the child is lifted via handle 12. In this particular embodiment, the reinforced seams include a right shoulder seam 34 and a left shoulder seam 36.

Figure 2B:
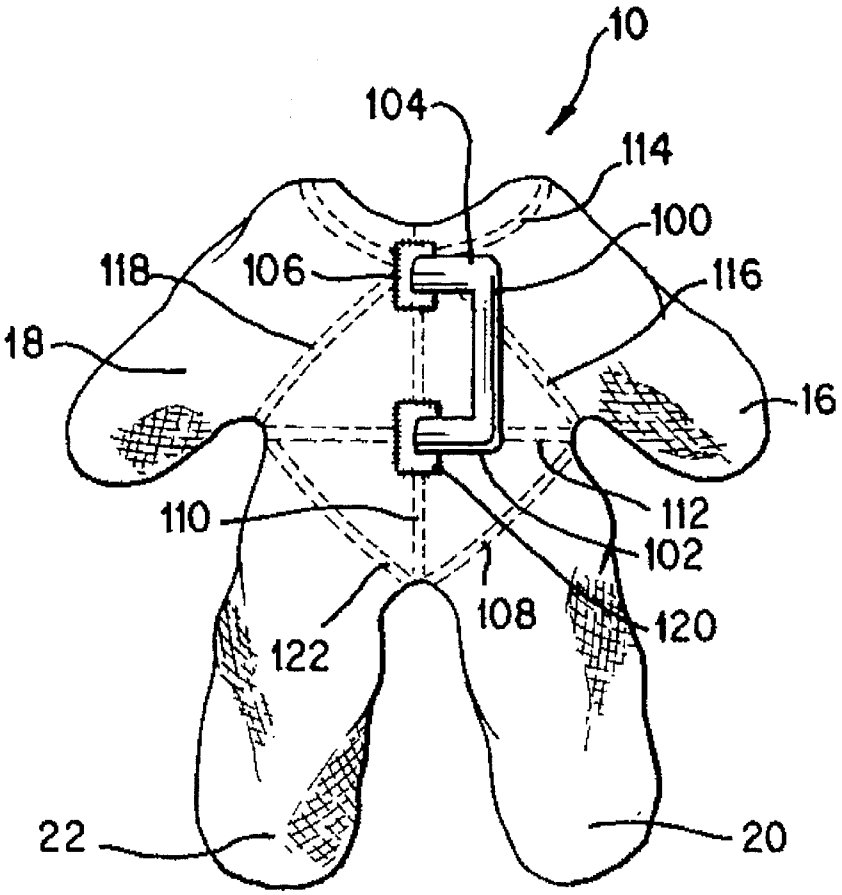
FIG. 2 shows front and back views of a garment of the present invention with a longitudinal handle.
Figure 2A:
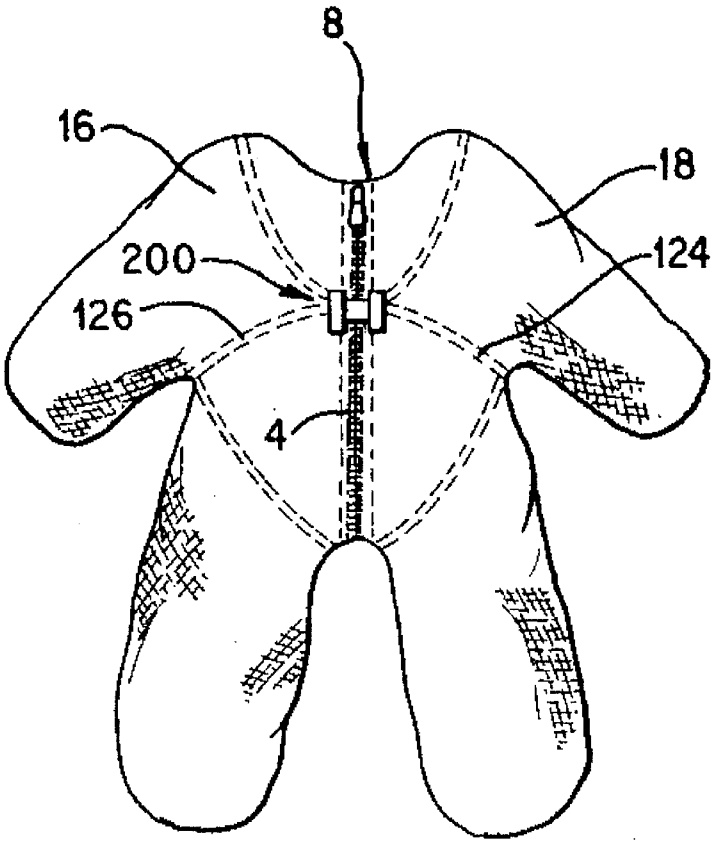

These seams 34 and 36 extend across the rear of garment 10 from the shoulder portions 2 and 3 to the garment crotch 6 and extend to the front of the garment as well, as can be seen in both FIGS. 1 and 2. Transverse or cross seam 38 extends laterally and connects right and left shoulder seams 34 and 36 at a position beneath the neck portion 8 and between the sleeves 16 and 18. Rear underarm seams 40 and 42 extend from the intersection of seams 34 and 38, and 36 and 42, respectively, downwardly to the underarm portion of the garment. Similarly, torso seams 44 and 46 extend from crotch 6 to the underarm portion of sleeves 16 and 18 and terminate at the same position as seams 40 and 42.

Seams 40 and 44 merge to form seam 48 on the front portion of the garment, as seen in FIG. 1. Correspondingly, seams 42 and 46 merge to form front seam 50 which is opposite that of seam 48 on the front portion of the garment. In this way, seams 48 and 50, when the front portion of the garment is connected through a fastener such as a zipper 4, provide a means for supporting the child in the vicinity of the child's midriff. Of course, a series of buttons could be substituted for the zipper 4 without departing from the scope of the invention. Seams 34, 36, 48 and 50 on the front portion as shown in FIG. 1 can support the child when lifted from the rear by spreading the force imparted by the handle 12 over the child's torso.

It should be noted that the attaching pads 26 and 28 for securing the handle 12 to the garment are configured to attach to the intersection of the seams 34, 40 and 38 on the right side portion of the rear of the garment as shown in FIG. 1; and 36, 42 and 38 on the left hand side of the portion of the garment also as shown in FIG. 1. In this way, when the child is lifted, the forces are distributed through all of these seams such that the child is supported along seams 36 and 34 on the front of the garment, and seams 48 and 50 at the midriff along the front of the garment to widely disburse the forces imparted during lifting. In addition, because of the seams on the rear portion of the garment, much of the force is spread over the garment itself for lifting the child so that the seams do not carry all the weight. The seams and handle are located at a position relative to the neck, the sleeves and the legs so not to injure the child. In fact, it is this location of seams and the handle that minimize any discomfort that the child may otherwise suffer as a result of being lifted via the handle.

Another embodiment is shown in FIG. 2. In FIG. 2, the handle 100 is made of the same material and has the same configuration as the handle 12 in the embodiment shown in FIG. 1 except that it is arranged in a vertical direction rather than a horizontal one. With this particular configuration, a different pattern is used for distributing the stress points and maintaining the proper support. Here a collar seam 114 on the rear portion of the garment is arcuate and extends between each shoulder generally parallel to neck portion 8 of the garment 10. A vertical seam 110 extends from neck portion 8 to the crotch as shown. Lateral seam 112 is arranged such that it intersects seam 110 and is located between the underarm portions of the sleeves 16 and 18. The handle 100 is arranged such that the pads 106 and 108 are fixed to the garment along the line defined by seam 110. Lower pad 108 is attached at the intersection of seams 110 and 112, and the upper pad 106 is affixed to the intersection of seam 110 and 114. Additional seams are included to further distribute the force. For example, seams 120 and 122 extend between the crotch and the underarm of the respective sleeves (16 and 18). Upper seams 116 and 118 extend between the intersection of collar seam 114 and the vertical seam 110 and the underarms of sleeves 16 and 18, respectively.

Looking at the front portion of the garment, it can be seen that some of these seams merge to form single seams in the front. For example, seam 124 connects one portion of buckle 200 to the intersection of rear seams 118, 112 and 122. Similarly, front seam 126 extends between buckle 200 and the intersection of seams 116, 112 and 120 at the underarm of sleeve 16.

Front reinforced seams 120 and 122 are a continuation of the same seams in the rear. Similarly, the collar seam 114 extends about front portion of the garment to completely circumscribe the neck portion 8.

As can be seen from the front portion of the garment, seams 124 and 126 are connected to either side of buckle 200. In this manner, when the two portions of buckle 200 are connected, the seams are connected to one another to distribute the force imparted by the handle when lifted from the rear.

In operation, this second embodiment is similar to the first embodiment discussed above except of course the handle is arranged in a vertical rather than horizontal position and the seams have a somewhat different pattern for supporting the child. The effect is the same in that the force distributed with minimal discomfort to the child being carried.

This invention contemplates that the harness need not be integral with the garment itself. The harness could be separate with the handle attached to the harness and with the handle either on the front or the rear of the garment without departing from the scope of the invention. Furthermore, adjustable means could be used to allow the handle to be moved to a desirable position to fit the needs of a particular child or garment.

Figure 3B:
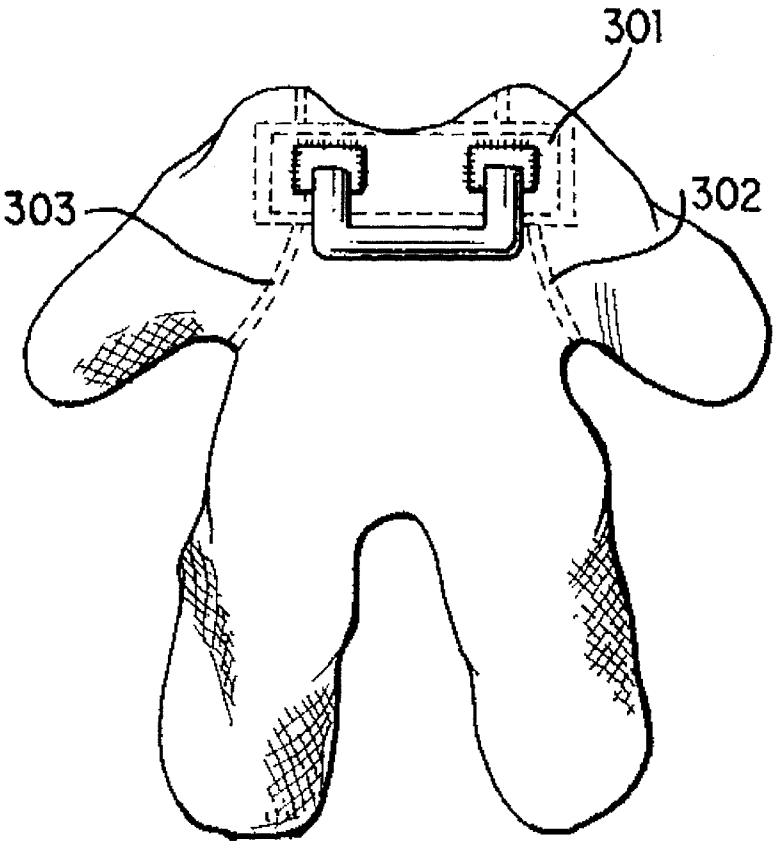
FIG. 3 shows front and back views of a garment of the present invention with an integrated handle.
Figure 3A:
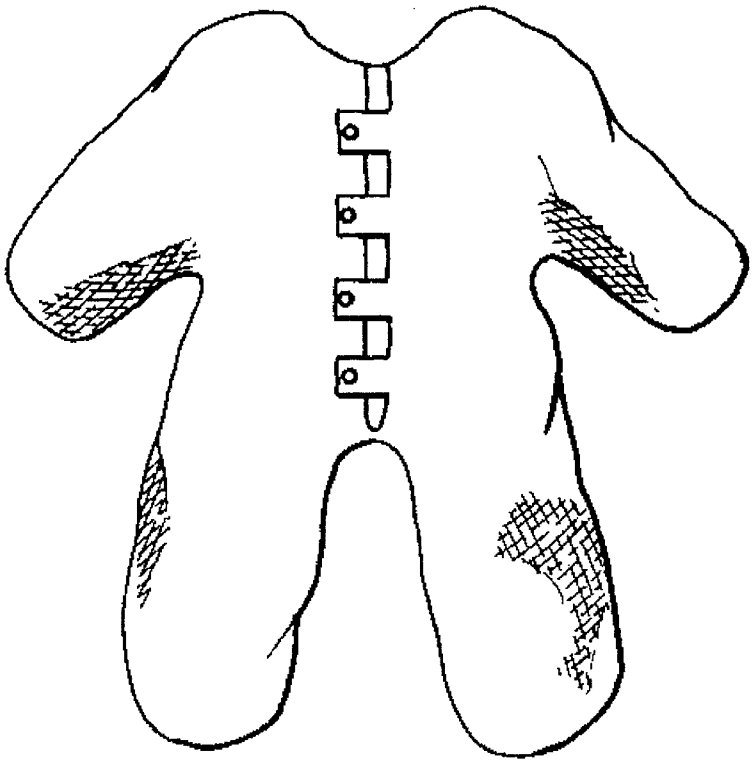

FIG. 3 shows an embodiment of the invention in which the handle 301 occupies a stitched-in rectangular section which distributes the force of lifting across the upper section of the torso. Seams 302 and 303 serve to further distribute the force under the arms. In this embodiment, the actual fabric itself provides much of the strength and support so as to obviate the need for additional internal reinforcement fabric or harnessing. Fabrics such as rip-stop nylon, heavier gauge corduroy, or denim might satisfy this criterion.

Figure 4:
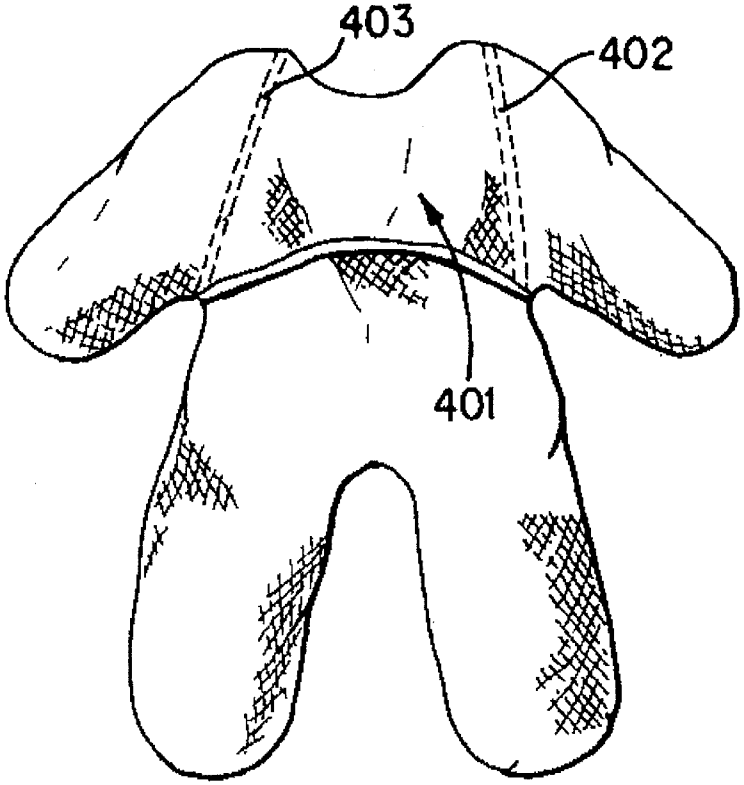
FIG. 4 shows an embodiment of the invention in which a handle is made by using an inverted pocket.

FIG. 4 shows an embodiment of the invention in which the "handle" is provided by means of an inverted pocket or cape-like attachment 401 secured by seams 402 and 403. In this embodiment, the child may be lifted by the adult via the adult either grabbing the cape section or by inserting their hand in the "pocket" of the cape section.

Figure 5:
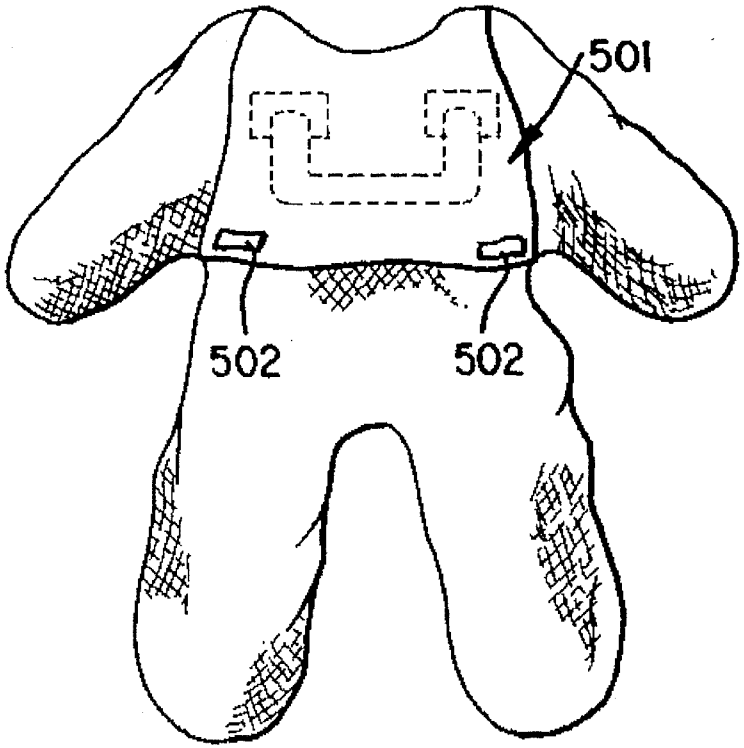
FIG. 5 shows an embodiment of the invention in which a handle is covered by a cosmetic flap.

FIG. 5 shows a cosmetic overflap 501 which may serve to cover the handle in any of the other embodiments. Cosmetic overflap 501 may be held down be fasteners 502 and 503. Fasteners 502 and 503 may be hook and loop fasteners as sold under the trademark VELCRO, buttons, snaps, or other such fasteners.

Figure 6:
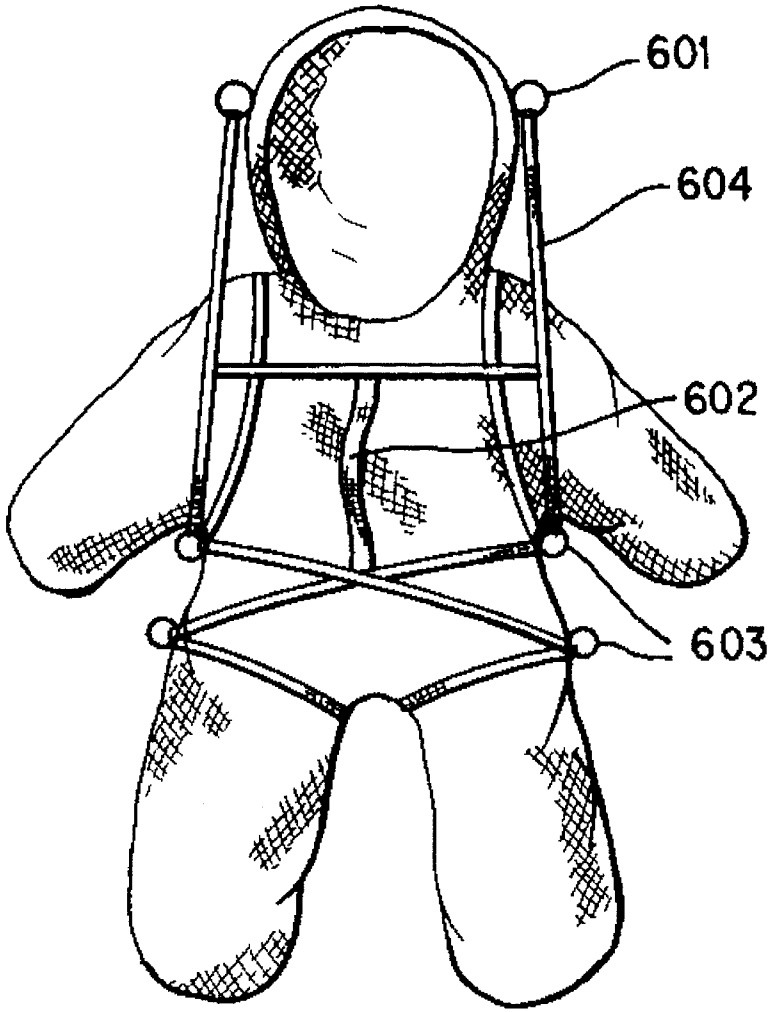
FIG. 6 shows an embodiment of the invention which includes removable straps.

FIG. 6 shows another embodiment whereby removable straps 604 can hook into integrated carry-points at eyelets 603. A removable handle 602 can also be attached. This embodiment allows the garment to be used as a horizontal sleeper or tote. For this application, it is advantageous to provide a hood and hood eyelets 601 so as to provide support for the head.

Figure 7:
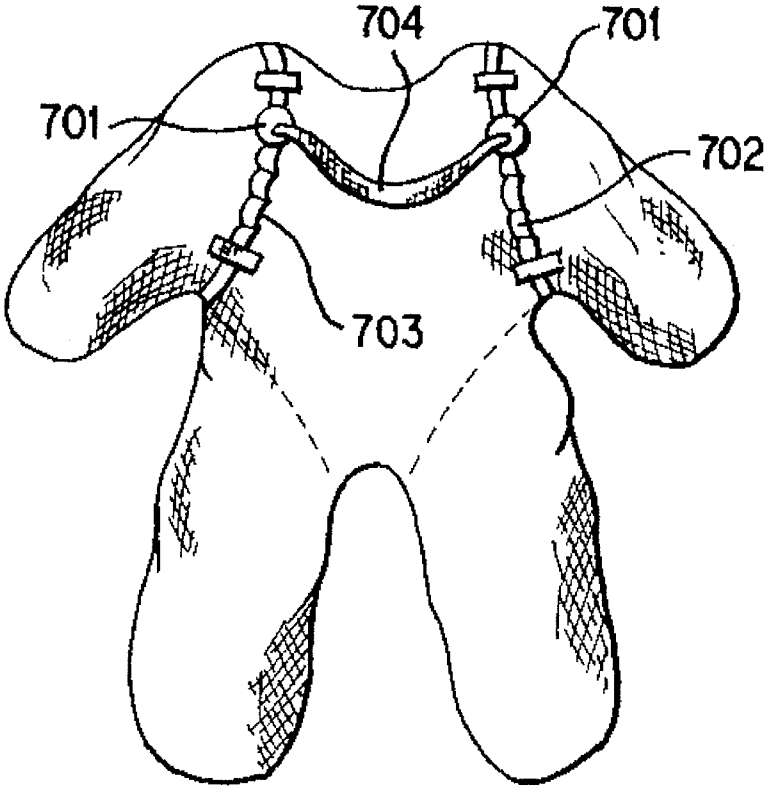
FIG. 7 shows an embodiment of the invention which includes an adjustable positioning strap.

FIG. 7 shows another embodiment of the invention with an adjustable positioning strap which can modify the center of gravity for both comfort and safety. In this embodiment, a handle 704 is positioned between straps 702 and 703. Adjustable buckles 701 allow numerous positions to be taken by handle 704 so as to allow for maximum comfort to the child.

Figure 8:
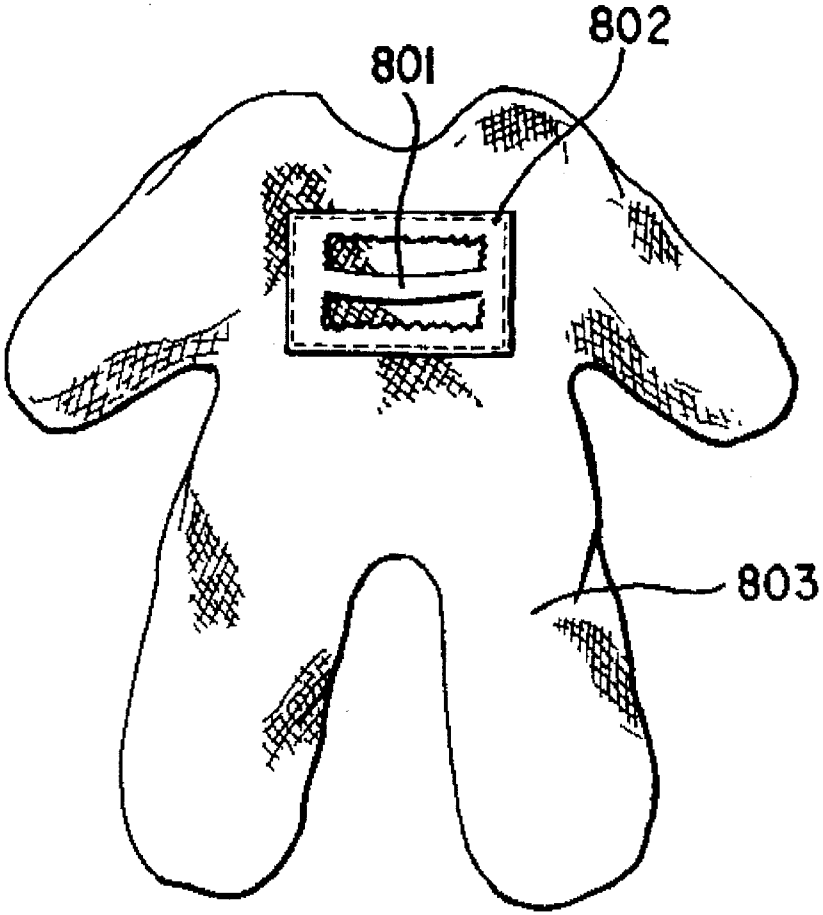
FIG. 8 shows an embodiment of the invention in which a handle is stitched or fastened onto the child's garment.

FIG. 8 shows a last embodiment in which a handle section 801 connected to a stitching section 802 may be stitched onto an existing article of clothing 803. In this fashion, all garments may be adapted to use the current invention, even if not manufactured with the aforementioned reinforced seam or harness system.

What is claimed is:

1. A garment for a child, comprising:

a torso portion;

two sleeve portions;

two leg portions;

two pads located on said torso portion; and a handle secured to said two pads for permitting carrying of the child via said handle without injury to the child wherein said garment further includes a pattern of seams attached to said two pads for reinforcing the garment to support the child such that at least one of said seams passes around the crotch of the child to permit carrying of the child via the garment in both prostrate and upright positions.

2. The garment of claim 1 wherein said handle includes a gripping portion arranged and displaced from the rear of the garment by two handle extensions, one from each end of said gripping portion.

3. The garment of claim 2 wherein said handle is affixed to said garment beneath the neck portion and between the sleeves of the garment.

4. The garment of claim 1 further comprising:

two shoulder portions;

a neck portion between said two shoulder portions; and a crotch; wherein a portion of said reinforcing seams extend between each of said shoulder portions and the crotch along the rear portion of the garment and said shoulder portion and said crotch along the front portion of the garment.

5. The garment of claim 4 wherein a portion of said reinforcing seams extends between said crotch and the underarms of said sleeves and extends around to the front midriff of the garment.

6. The garment of claim 5, further comprising a reinforced transverse seam extending between said pads and between the shoulder portions.

7. The garment of claim 6, further comprising upper underarm seams that extend between the underarms of the garment and shoulder seams that extend over said shoulder portions of the garment, said underarm seams intersecting with said shoulder seams at the intersection of said transverse seam.

8. The garment of claim 7, further comprising a separable fastener for attaching the front portion of the garment.

9. The garment of claim 8, wherein said fastener is a zipper.

10. The garment of claim 8, wherein said fastener is a buckle.

11. The garment of claim 8, wherein said fastener is a series of buttons.

12. The garment of claim 1, wherein said handle is arranged parallel to the child's waist.

13. The garment of claim 1, further comprising a cosmetic overflap for covering said handle.

14. The garment of claim 1, wherein said handle is arranged perpendicular to the child's waist.

15. The garment of claim 1, wherein said seam pattern is disposed so as to evenly distribute the weight of the child over the area of the garment when the child is lifted.

16. A garment for a child, comprising:

a torso portion;

two sleeve portions;

two leg portions;

a handle secured to said torso portion for permitting carrying of the child via said handle without injury to the child wherein said garment further includes a pattern of seams attached to said torso portion for reinforcing the garment to support the child, such that at least one of said reinforcing seams passes around the crotch of the child to permit carrying of the child via the garment in both prostrate and upright positions.

* * * * *